US007909563B2

(12) United States Patent
Prentice

(10) Patent No.: US 7,909,563 B2
(45) Date of Patent: Mar. 22, 2011

(54) FORK POSITIONER

(75) Inventor: Glenn Prentice, Milwaukie, OR (US)

(73) Assignee: Cascade Corporation, Fairview, OR (US)

( * ) Notice: Subject to any disclaimer, the term of this patent is extended or adjusted under 35 U.S.C. 154(b) by 1489 days.

(21) Appl. No.: 11/000,783

(22) Filed: Nov. 30, 2004

(65) Prior Publication Data

US 2006/0115349 A1 Jun. 1, 2006

(51) Int. Cl.
*B66F 9/14* (2006.01)

(52) U.S. Cl. ..... 414/667; 414/607; 187/274

(58) Field of Classification Search ..... 414/607, 414/667; 187/223, 224, 227, 269, 274, 275, 187/276, 277, 285, 306
See application file for complete search history.

(56) References Cited

U.S. PATENT DOCUMENTS

| | | | |
|---|---|---|---|
| 3,092,274 | A | 6/1963 | Harris |
| 3,754,673 | A | 8/1973 | Barda et al. |
| 4,125,199 | A | 11/1978 | Abels et al. |
| 4,335,992 | A | 6/1982 | Reeves |
| 4,381,166 | A | 4/1983 | Smart |
| 4,392,772 | A | 7/1983 | Reeves |
| 4,395,188 | A | 7/1983 | Kaup |
| 4,406,575 | A | 9/1983 | Gaibler |
| 4,533,290 | A | 8/1985 | Hackauf |
| 4,756,661 | A | 7/1988 | Smart |
| 4,902,190 | A | 2/1990 | House |
| 5,033,934 | A | 7/1991 | Emilio |
| 5,096,363 | A | 3/1992 | Weinert et al. |
| 5,336,039 | A | 8/1994 | House |
| 5,807,060 | A | 9/1998 | Hamlik |
| 6,390,763 | B1 | 5/2002 | Prentice |
| 6,672,823 | B2 | 1/2004 | Henning |
| 2003/0049116 | A1 | 3/2003 | Henning |

FOREIGN PATENT DOCUMENTS

| | | |
|---|---|---|
| DE | 28 35 031 | 2/1980 |
| DE | 34 00 916 C2 | 3/1988 |
| DE | 36 32 031 A 1 | 4/1988 |
| DE | 36 39 933 A 1 | 6/1988 |
| DE | 40 41 846 A 1 | 6/1992 |
| DE | 35 15 524 C 2 | 12/1994 |
| DE | 9418354.6 U1 | 1/1995 |
| DE | 196 29 194 A 1 | 1/1997 |
| DE | 101 09 851 A 1 | 9/2001 |
| GB | 2 030 542 A | 4/1980 |

(Continued)

OTHER PUBLICATIONS

Official Action dated Jan. 12, 2009, Amendment dated May 6, 2009, and Notice of Allowance dated Jul. 6, 2009, in corresponding Canadian application No. 2,584,967.

(Continued)

*Primary Examiner* — Michael S Lowe
(74) *Attorney, Agent, or Firm* — Chernoff Vilhauer

(57) ABSTRACT

A fork positioner, usable alternatively either as an attachment to an existing load-lifting carriage with forks, or as part of the original equipment of a load-lifting carriage, has a pair of elongate hydraulic piston and cylinder assemblies mountable in an interconnected parallel relationship between an upper transverse fork-supporting member and a lower transverse member of the carriage. Each of a pair of fork-positioning guide members has a fork-engagement surface movable by a respective piston and cylinder assembly and connectable thereto so that the fork-engaging surfaces face substantially perpendicularly away from an imaginary plane containing the respective longitudinal axes of the piston and cylinder assemblies. An exemplary carriage mounting the fork positioner is also disclosed.

11 Claims, 5 Drawing Sheets

FOREIGN PATENT DOCUMENTS

| | | | |
|---|---|---|---|
| JP | 53-61982 | | 5/1978 |
| JP | 53-79673 | | 7/1978 |
| JP | 54-120075 | | 8/1979 |
| JP | 56-121095 | | 9/1981 |
| JP | 56-140595 | | 10/1981 |
| JP | 56-144098 | | 10/1981 |
| JP | 59-172399 | | 9/1984 |
| JP | 61-132397 | | 8/1986 |
| JP | 61-36553 | Y2 | 10/1986 |
| JP | S62-89295 | | 6/1987 |
| JP | S62-259997 | | 11/1987 |
| JP | 64-500423 | A | 2/1989 |
| JP | 1-70793 | U | 5/1989 |
| JP | 2-095698 | | 4/1990 |
| JP | 2-276799 | | 11/1990 |
| JP | 6-15988 | Y2 | 4/1994 |
| JP | 2561847 | | 10/1997 |
| WO | WO82/00997 | | 4/1982 |
| WO | WO92/21606 | | 12/1992 |
| WO | WO2004/007338 | A1 | 1/2004 |

OTHER PUBLICATIONS

International Preliminary Report on Patentability dated Jun. 14, 2007 in corresponding International Applciation No. PCT/US2005/036979.

Supplementary European Search Report dated Mar. 12, 2009 with European Search Opinion, Examination report dated Aug. 28, 2009, and Amendment dated Jan. 5, 2010, in corresponding European application No. 05812455.3.

First Office Action dated Jan. 16, 2009, Response to First Office Action dated May 27, 2009, Second Office Action dated Sep. 4, 2009, and Response to Second Office Action dated Nov. 17, 2009, in corresponding Chinese Application No. 200580040942.1.

First Office Action dated Aug. 2, 2010 in corresponding Japanese application No. 2007-543050.

FORK POSITIONER

BACKGROUND OF THE INVENTION

This invention relates to a fork positioner for moving the load-lifting forks of a lift truck carriage selectively toward or away from each other so as to change their transverse separation. More particularly, the invention relates to a fork positioner which can be attached to an existing lift truck carriage, or incorporated as original equipment in a newly-manufactured carriage.

Fork positioners actuated by pairs of hydraulic cylinders, motor-driven screws, or the like have been used extensively on fork-supporting lift truck carriages. Most of these fork positioners are furnished as integral components of a carriage, often in combination with a side-shifting function which enables the carriage to be moved transversely so as to side-shift the forks in unison. Some detachably-mountable fork positioners have been provided in the past, such as those shown in U.S. Pat. Nos. 4,756,661, 4,902,190 and 6,672,823, to enable existing lift truck carriages without fork-positioning capability to be provided with such capability. However such detachably-mounted side-shifters have in the past increased the dimensions of the lift truck carriage, either horizontally as shown in U.S. Pat. No. 4,756,661 which reduces the load-carrying capacity of a counterbalanced lift truck by moving the load forward, or vertically as shown in U.S. Pat. Nos. 4,902,190 and 6,672,823 which impairs the lift truck operator's visibility over the top of the carriage.

BRIEF SUMMARY OF THE INVENTION

A need therefore exists for a highly-compact fork positioner which does not require such increased dimensions, does not significantly impair operator visibility, and is easy to mount on existing carriages or newly-manufactured carriages.

The foregoing and other objectives, features, and advantages of the invention will be more readily understood upon consideration of the following detailed description taken in conjunction with the accompanying drawings.

BRIEF DESCRIPTION OF THE SEVERAL DRAWINGS

DETAILED DESCRIPTION OF PREFERRED EMBODIMENTS

Figure 2:
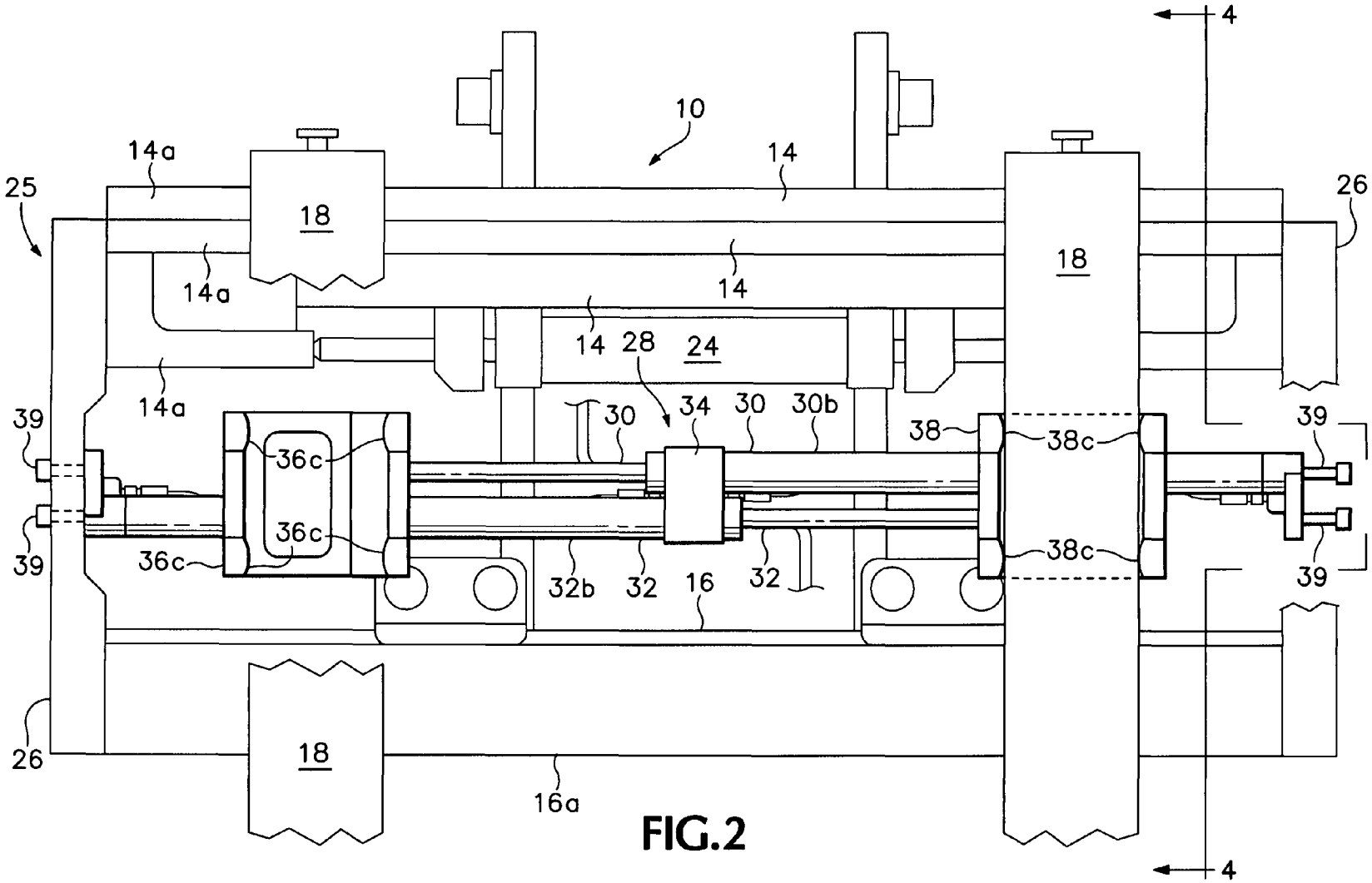
FIG. 2 is a front view of an exemplary load-lifting carriage mounting the fork positioner of FIG. 1.
Figure 3:
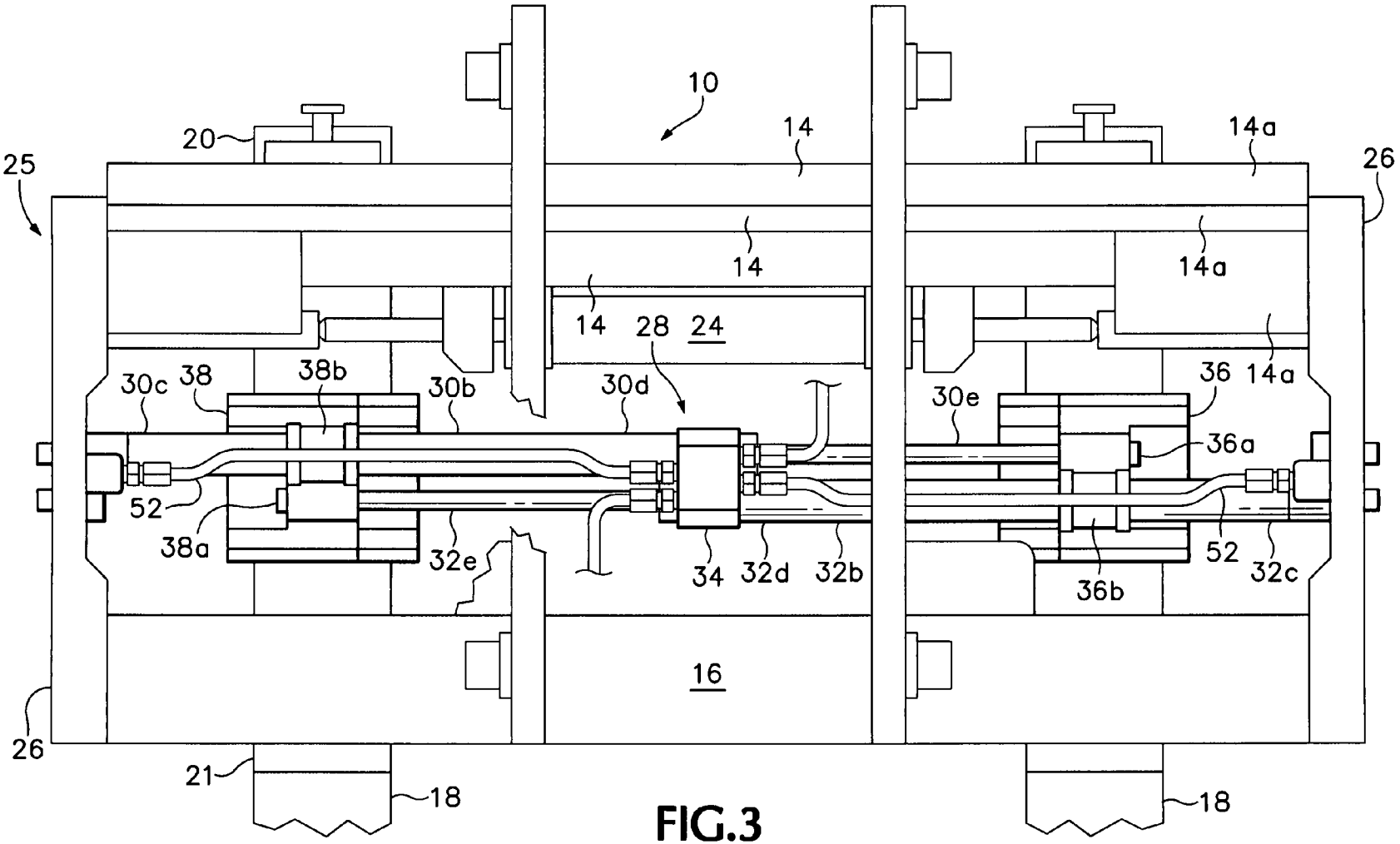
FIG. 3 is a rear view of the carriage of FIG. 2.
Figure 4:
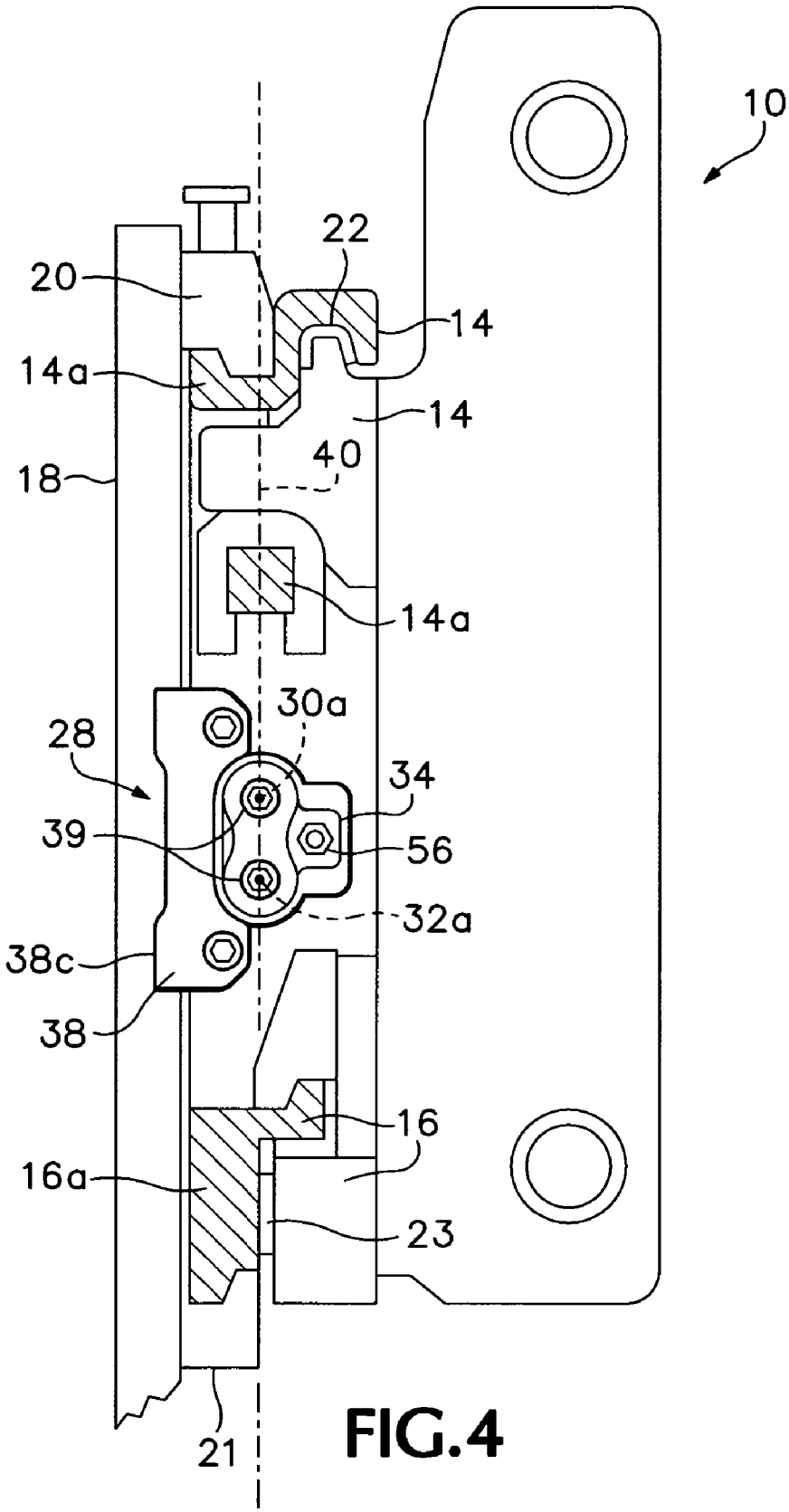
FIG. 4 is a partially sectional side view of the carriage of FIG. 2, taken along line 44.

FIGS. 2-4 show an exemplary embodiment of a load-lifting carriage 10 mountable for vertical movement on the mast of an industrial lift truck (not shown). The carriage 10 can be any of numerous different types, usually having an upper transverse fork-supporting member such as 14 and a lower transverse member such as 16 mounting two or more load-lifting forks such as 18 by means of fork hooks 20, 21 (FIG. 4) slidably engaged for transverse movement by hook portions 14*a* and 16*a*, respectively, of upper member 14 and lower member 16. The hook portions 14*a* and 16*a* may be integral parts of the upper member 14 and lower member 16 respectively if the carriage 10 is of a simple standard type. Alternatively, the hook portions 14*a* and 16*a* may be transversely movable relative to the remainder of the upper member 14 and lower member 16 on slide bushings such as 22, 23 (FIG. 4) under the control of a bidirectional side-shifting hydraulic piston and cylinder assembly 24 interacting between a side-shifting frame 25 containing the hook portions 14*a*, 16*a*, and the remainder of the carriage 10. Such a side-shifting frame 25 enables the forks 18 to be moved transversely in unison if desired.

As shown in FIG. 2, the upper hook portion 14*a* and lower hook portion 16*a* of the carriage 10 are joined by respective end members 26 of the frame 25 which side-shift transversely in unison with the hook portions 14*a*, 16*a* and the forks 18. Alternatively, if the carriage 10 is not of the side-shifting type, such end members 26 can join the upper member 14 and lower member 16 of a standard carriage.

If the carriage 10 is of the side-shifting type, its side-shifting piston and cylinder assembly 24 is preferably located immediately beneath, rather than above, the upper member 14 to maximize the operator's visibility over the top of the carriage when the carriage is lowered, and to leave an open space between the side-shifting piston and cylinder assembly 24 and the lower member 16 for enhanced operator visibility through the center of the carriage.

Figure 1:
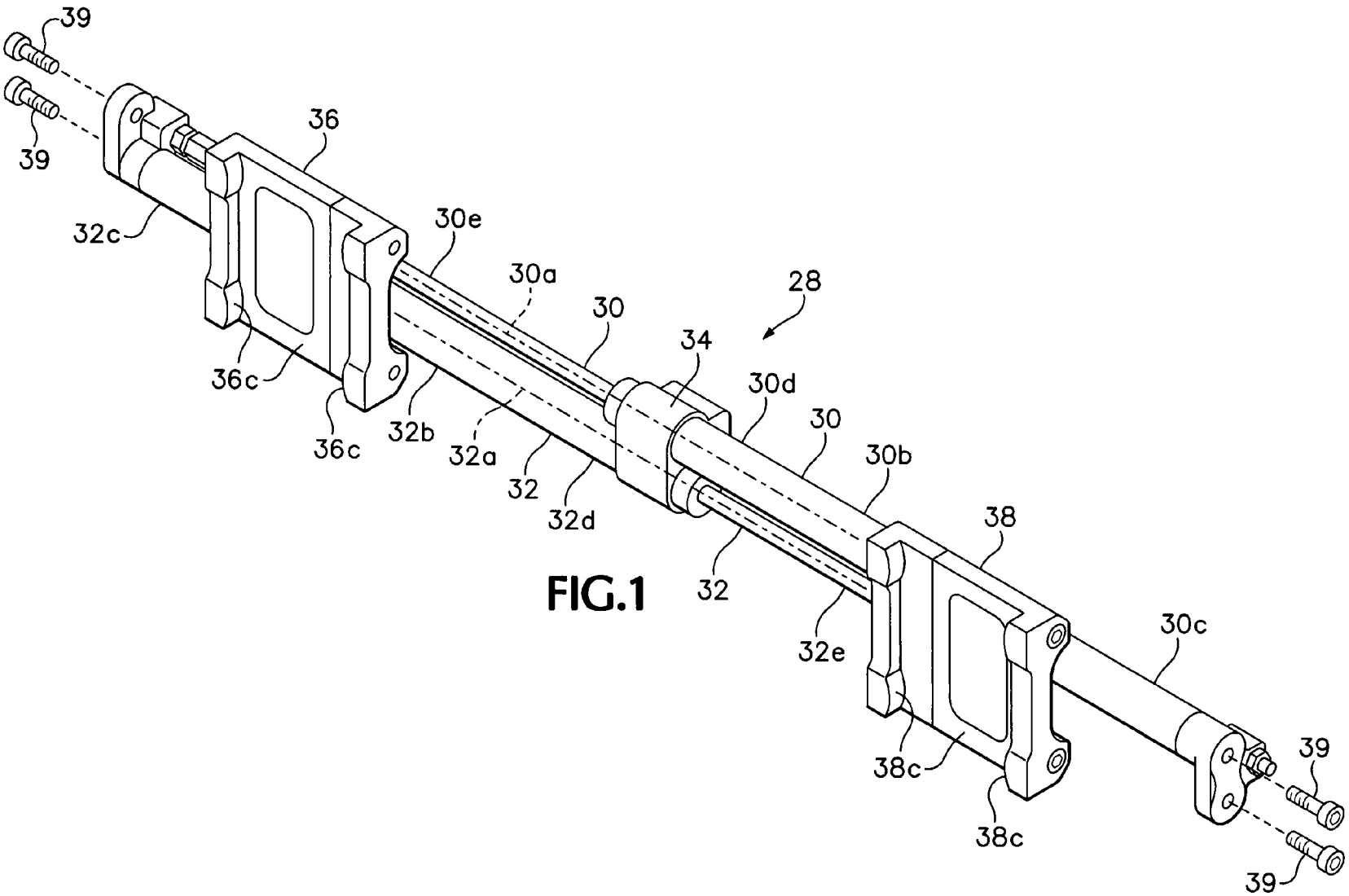
FIG. 1 is a perspective view of an exemplary embodiment of a fork positioner in accordance with the present invention, shown prior to mounting on a load-lifting carriage.

It is often desirable that the carriage 10, whether or not of the side-shifting type, be provided with a fork positioner for enabling the forks 18 to be selectively moved toward or away from each other so as to adjust the transverse spacing between them. To provide this function, a unique fork positioner indicated generally as 28 is disclosed in FIG. 1. The fork positioner 28 may either be conveniently mounted to an existing carriage 10 having no fork-positioning capability or, alternatively, included as part of a carriage 10 as originally manufactured. The fork positioner 28 includes a pair of elongate, bidirectional hydraulic piston and cylinder assemblies 30 and 32 having respective longitudinal axes 30*a*, 32*a* (FIG. 1) and each having a respective cylinder 30*b*, 32*b* with a respective base portion 30*c*, 32*c* at one end and a respective rod end portion 30*d*, 32*d* at the other end from which a respective piston rod 30*e*, 32*e* is extensible along a respective axis 30*a*, 32*a*. A cylinder connector 34 is adapted to threadably interconnect the rod end portion 30*d* of one cylinder rigidly to the rod end portion 32*d* of the other cylinder so that the axes 30*a* and 32*a* are parallel to each other. When the cylinders are interconnected in this manner, the piston rod 30*e*, 32*e* of each of the pair of piston and cylinder assemblies is extensible into longitudinally-overlapping relationship to the cylinder of the other piston and cylinder assembly as shown in FIG. 1.

A pair of fork-positioning guide members 36, 38 each connects to a respective piston rod 30*e*, 32*e* by means of a respective rod connector 36*a*, 38*a* (FIG. 3) while also slidably and guidably engaging the respective cylinder 32*b*, 30*b* of the opposite piston and cylinder assembly by a respective slide bushing 36*b*, 38*b*. This arrangement enables a recessed fork-engagement surface 36*c*, 38*c* (FIG. 1) of each respective guide member to face away from the respective longitudinal axes 30*a*, 32*a* of the piston and cylinder assemblies in a forward direction substantially perpendicular to an imaginary plane 40 (FIG. 4) containing both of the longitudinal axes 30*a* and 32*a*. When the fork positioner 28 is mounted on the carriage 10, the plane 40 also interconnects the upper transverse member 14 and lower transverse member 16 since the piston and cylinder assemblies 30 and 32 are inserted between the members 14 and 16.

When the fork positioner 28 has been mounted to the carriage in an inserted position between the upper member 14 and the lower member 16 as shown in the figures, the piston and cylinder assemblies 30 and 32 can move the guide members 36 and 38 selectively toward and away from each other. Fork positioning force is applied by the guide members 36, 38 to the sides of the respective forks 18 in a substantially direct, nonbinding fashion so that the forks slide easily toward and away from each other along the upper transverse fork-supporting member 14. To maximize this nonbinding force transmission, the fork-engaging surfaces 36*c*, 38*c* are preferably vertically coextensive with at least a major portion of the distance separating the respective longitudinal axes 30, 32*a* of the piston and cylinder assemblies.

In order to provide easy mounting of the fork positioner on the carriage 10 in its inserted position between the upper member 14 and lower member 16, the piston and cylinder assemblies 30 and 32 are preferably mountable on the carriage 10 while interconnected with each other as a unit, for example by the cylinder connector 34 and/or the fork-positioning guide members 36, 38. This unitized insertable fork positioner package requires no unitizing framework other than the piston and cylinder assemblies themselves and, if desired, also the fork-positioning guide members. The resultant rigid, essentially frameless fork positioner unit is thus so compact that it can be mounted in its inserted position centrally on the carriage 10 without significantly impairing the operator's visibility, or altering the dimensions of the carriage 10 in a way that would push the load forwardly and thereby reduce the load-carrying capacity of the lift truck. Moreover, mounting of the fork positioner on the carriage is greatly simplified by the unitized nature of the fork positioner, and by the fact that only the piston and cylinder assemblies 30, 32 must be supportably connected to the carriage 10 since the fork-positioning guide members 36, 38 are supportable by the piston and cylinder assemblies 30, 32 independently of any engagement by either guide member with a fork 18.

One possible easy mounting arrangement for the piston and cylinder assemblies 30 and 32 is to connect the respective base portions 30*c*, 32*c* of the cylinders to respective end members 26 of the carriage 10 by screws 39 as shown in the drawings or by any other convenient means. If an existing carriage 10 has no such end members, they can easily be added to the carriage as part of the assembly process. Alternatively, the piston and cylinder assemblies 30*a*, 32*a* could be more centrally mounted to the carriage 10 by one or more brackets attached to the carriage upper member 14 or 14*a* in a manner which does not significantly impair operator visibility through the center of the carriage.

Figure 5:
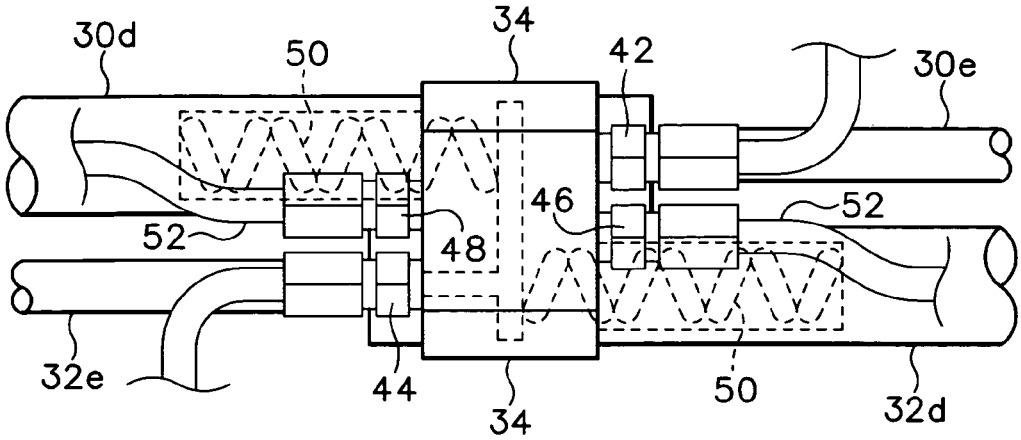
FIG. 5 is an enlarged rear detail view of a center portion of the fork positioner of FIG. 1 showing interior hydraulic conduits.
Figure 6:
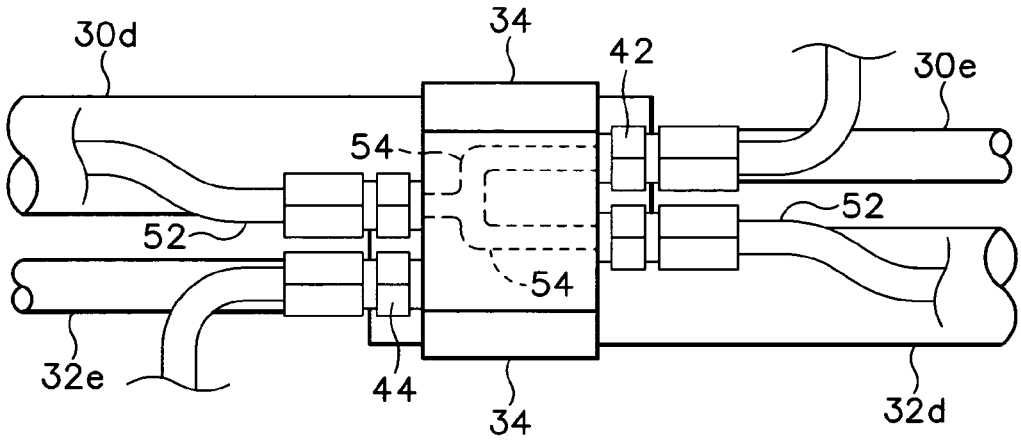
FIG. 6 is an enlarged rear detail view of a center portion of the fork positioner of FIG. 1 showing other interior hydraulic conduits.
Figure 7:
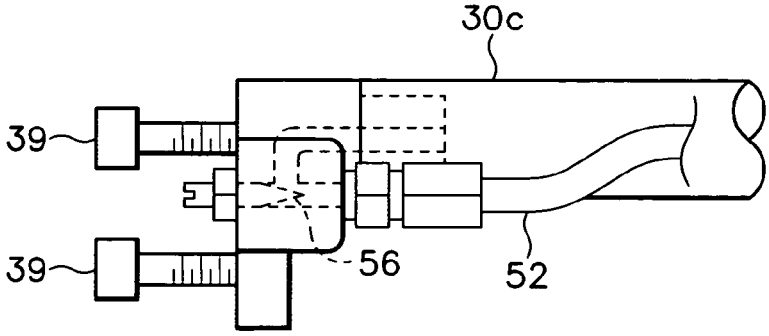
FIG. 7 is an enlarged rear detail view of a base portion of one of the piston and cylinder assemblies of the fork positioner of FIG. 1.

Preferably, the cylinder connector 34 includes one or more hydraulic fluid line connectors 42, 44, 46, 48 communicating with the interiors of the respective cylinders 30*b*, 32*b*. For example, one such connector 44 (FIG. 5) can introduce pressurized fluid simultaneously to the rod end portions 30*d*, 32*d* of the cylinders through internal spiral conduits 50 to retract the piston rods 30*e*, 32*e* simultaneously, while another connector 42 (FIG. 6) communicating with interior conduits 54 and exterior conduits 52 can exhaust hydraulic fluid simultaneously from the base portions 30*c*, 32*c* of the cylinders. Respective conventional flow equalizer valves such as 56 (FIG. 7) in each base portion 30*c*, 32*c* achieve uniform movement of the piston rods. An operator control valve (not shown) can reverse the flows of pressurized fluid and exhaust fluid through connectors 42 and 44 respectively to similarly extend the piston rods.

Although the preferred form of the fork positioner utilizes piston and cylinder assemblies wherein each cylinder 30*b*, 32*b* is connected to the carriage 10 so as to prevent the cylinder's longitudinal movement relative to the carriage, a reversed structure wherein piston rods are connected to the carriage so that their cylinders can move the fork-positioning guide members would also be within the scope of the invention.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. A fork positioner mountable on a load-lifting carriage having, prior to mounting of said fork positioner on said carriage, an elongate upper transverse fork-supporting member extending longitudinally in a transverse direction and capable of operably vertically supporting a transversely-movable pair of load lifting forks, and a lower transverse member below said upper transverse fork-supporting member, said fork positioner comprising:

(a) a pair of elongate hydraulic piston and cylinder assemblies having respective longitudinal axes, said piston and cylinder assemblies being interconnectable, without any mounting of said piston and cylinder assemblies on said carriage, as an elongate, substantially rigid unit with said axes in a substantially parallel, longitudinally overlapping relationship, said rigid unit being operably mountable on said carriage in an inserted position with said piston and cylinder assemblies located vertically between said upper transverse fork-supporting member and said lower transverse member of said carriage and with said respective longitudinal axes extending substantially in said transverse direction in a vertically spaced relationship; and (b) a pair of fork-positioning guide members, each having a fork engagement surface, each operably mountable on said rigid unit so as to be movable transversely by a respective one of said pair of piston and cylinder assemblies between respective fork-positioning locations when said rigid unit is mounted in said inserted position.

2. The fork positioner of claim 1 wherein said pair of fork-positioning guide members are operably mountable on said rigid unit so as to be supportable vertically by said rigid unit in said respective fork-positioning locations when said rigid unit is mounted in said inserted position.

3. The fork positioner of claim 1 wherein said pair of fork-positioning guide members are operably mountable on said rigid unit so as to be insertable together with said rigid unit into said inserted position.

4. The fork positioner of claim 1 wherein said piston and cylinder assemblies are mountable as said rigid unit in said inserted position on said carriage so that said respective longitudinal axes of said piston and cylinder assemblies define an imaginary plane which intersects said upper transverse fork-supporting member longitudinally.

5. The fork positioner of claim 1 wherein said piston and cylinder assemblies have respective ends at longitudinally opposite extremities of said rigid unit when interconnected as said rigid unit, said piston and cylinder assemblies being interconnectable as said rigid unit without any mounting of said piston and cylinder assemblies on said carriage, and without any rigid interconnection between said ends other than through said piston and cylinder assemblies.

6. The fork positioner of claim 1 wherein said piston and cylinder assemblies are interconnected as said rigid unit without any mounting of said rigid unit on said carriage.

7. A fork positioner mountable on a load-lifting carriage having, prior to mounting of said fork positioner on said carriage, an elongate upper transverse fork-supporting member extending longitudinally in a transverse direction and capable of operably vertically supporting a transversely-movable pair of load-lifting forks, and a lower transverse member below said upper transverse fork-supporting member, said fork positioner comprising:

(a) a pair of elongate hydraulic piston and cylinder assemblies having respective longitudinal axes, said piston and cylinder assemblies being interconnected, without any mounting of said piston and cylinder assemblies on said carriage, as an elongate, substantially rigid unit with said axes in a substantially parallel, longitudinally overlapping relationship, said rigid unit being operably mountable on said carriage in an inserted position with said piston and cylinder assemblies located vertically between said upper transverse fork-supporting member and said lower transverse member of said carriage and with said respective longitudinal axes extending substantially in said transverse direction in a vertically spaced relationship; and (b) a pair of fork-positioning guide members, each having a fork-engagement surface, each operably mountable on said rigid unit so as to be movable transversely by a respective one of said pair of piston and cylinder assemblies between respective fork-positioning locations when said rigid unit is mounted in said inserted position.

8. The fork positioner of claim 7 wherein said pair of fork-positioning guide members are operably mountable on said rigid unit so as to be supportable vertically by said rigid unit in said respective fork-positioning locations when said rigid unit is mounted in said inserted position.

9. The fork positioner of claim 7 wherein said pair of fork-positioning guide members are operably mountable on said rigid unit so as to be insertable together with said rigid unit into said inserted position.

10. The fork positioner of claim 7 wherein said piston and cylinder assemblies are mountable as said rigid unit in said inserted position on said carriage so that said respective longitudinal axes of said piston and cylinder assemblies define an imaginary plane which intersects said upper transverse fork-supporting member longitudinally.

11. The fork positioner of claim 7 wherein said piston and cylinder assemblies have respective ends at longitudinally opposite extremities of said rigid unit, said piston and cylinder assemblies being interconnected as said rigid unit without any mounting of said piston and cylinder assemblies on said carriage, and without any rigid interconnection between said ends other than through said piston and cylinder assemblies.

* * * * *

UNITED STATES PATENT AND TRADEMARK OFFICE

CERTIFICATE OF CORRECTION

PATENT NO. : 7,909,563 B2
APPLICATION NO. : 11/000783
DATED : March 22, 2011
INVENTOR(S) : Glenn Prentice It is certified that error appears in the above-identified patent and that said Letters Patent is hereby corrected as shown below:

In Column 1, line 52, please change “along line 44” to --along line 4-4--.

Signed and Sealed this
Thirteenth Day of September, 2011

David J. Kappos

David J. Kappos
*Director of the United States Patent and Trademark Office*